United States Patent [19]

Rojey et al.

[11] 4,420,946

[45] Dec. 20, 1983

[54] PROCESS FOR PRODUCING COLD OPERATED WITH PHASE SEPARATION

[75] Inventors: Alexandre Rojey, Garches; Joseph Larue, Vaucresson; Alain Barreau, Chatou, all of France

[73] Assignee: Institut Francais du Petrole, Rueil-Malmaison, France

[21] Appl. No.: 326,320

[22] Filed: Dec. 1, 1981

[30] Foreign Application Priority Data

Dec. 1, 1980 [FR] France ..... 80 25514

[51] Int. Cl.[3] ..... F25B 15/00

[52] U.S. Cl. ..... 62/101; 62/476; 62/470; 62/513

[58] Field of Search ..... 62/473, 513, 114, 476, 62/101, 109, 470

[56] References Cited

U.S. PATENT DOCUMENTS 1,686,935 10/1928 Shipley ..... 62/473

*Primary Examiner*—William E. Wayner
*Assistant Examiner*—Henry Bennett
*Attorney, Agent, or Firm*—Millen & White

[57] ABSTRACT

Cold is produced in a phase separation cycle comprising the steps of (a) compressing a refrigerant fluid and dissolving it in a solvent, (b) cooling resultant solution to form two distinct liquid phases, (c) separating the liquid phases, (d) recycling the heavy phase, (e) expanding and vaporizing the light phase to produce cold, and (f) recycling the vaporized light phase. A portion of the cold produced in step (e) is used to cool the solution from step (a), and another portion is used to cool an external medium.

20 Claims, 4 Drawing Figures

PROCESS FOR PRODUCING COLD OPERATED WITH PHASE SEPARATION

BACKGROUND OF THE INVENTION

This invention relates to refrigeration machines using the vaporization of a refrigeration fluid to produce cold. In conventional 1-stage installations, the refrigeration fluid in vapor phase is compressed, condensed with heat delivery to an external fluid, most often water or air, and then expanded and supplied to the vaporization step.

When attempting to obtain relatively low refrigeration temperatures by this process, for example, temperatures lower than −40° C., it is found that the yield of the installation, which may be defined as the ratio of the refrigeration power obtained to the mechanical power consumed, sharply decreases when the desired refrigeration temperature itself decreases. This yield can be improved by operating with two stages in series, which permits attainment of a temperature of −100° C.

To avoid a doubling of the equipment employed, it is also possible to operate according to the technique of the French Pat. No. 2,314,456. This technique is described herein with reference to the schematic diagram of FIG. 1.

The refrigeration fluid vaporizes in exchanger E2 with cooling of an external fluid. It is then recycled to compressor K1 either directly or through exchanger E1, (the latter arrangement is shown in FIG. 1). The compressed vapor phase VFC is admixed with a solvent phase S. The mixture of the vapor phase VFC with the solvent phase passes through the exchanger C1 where the vapor phase condenses in the presence of the solvent. The resultant liquid phase is cooled in exchanger E1. When using adapted solvent-solute pairs, phase separation occurs with formation of two liquid phases, including a phase of high solvent content and a phase of high refrigeration fluid content, which phases are collected in the decantation drum B1. The solvent phase is carried along by pump P1 and recycled through exchanger E1. The liquid phase of high refrigeration fluid content is expanded through the expansion valve V1 and supplied to exchanger E2.

When analyzing the way this process operates, it is found that the temperature $T_d$ of the mixture of the refrigeration fluid with the solvent withdrawn from exchanger E1 and collected in drum B1 is an essential parameter. The lower this temperature $T_d$, the lower the concentration of refrigeration fluid in the solvent phase recycled from the drum B1. There results, when this temperature $T_d$ is decreased, the possibility to reduce the solvent recirculation rate and also the dissolution pressure.

When operating according to FIG. 1, the cooling of the mixture of solvent and solute discharged from condenser C1 is obtained by exchange with the solvent phase withdrawn from drum B1 and the vapor phase withdrawn from exchanger E2. In these conditions, there is no possibility to adjust the temperature $T_d$; on the other hand, because the calorific capacity of the refrigeration fluid in vapor phase is largely lower than the calorific capacity of the refrigeration fluid in liquid phase, this temperature $T_d$ cannot be decreased to a value close to the temperature attained in exchanger E2.

SUMMARY OF THE INVENTION

The improved process of the invention comprises the following steps:

(a) compressing, in a compression zone, a gas phase of refrigerant fluid, so as to form a compressed gas phase, dissolving at least partly the compressed gas phase in a liquid solvent phase, to obtain a solution, and transferring at least partly the compression heat and the dissolution heat to an external cooling fluid, (b) cooling the solution recovered from step (a) as shown in step (d), to obtain the separation of the solution into two distinct liquid phases, (c) separating the light liquid phase from the heavy liquid phase, (d) contacting the heavy liquid phase of step (c), in heat exchange relation, with the solution to be cooled of step (b) and supplying thereafter said heavy liquid phase, as a solvent phase, to step (a) to dissolve an additional amount of compressed gas phase, (e) expanding the light liquid phase of step (c) and vaporizing it to produce cold, (f) recycling the vaporized light phase of step (e) to the compression zone as a gas phase of refrigerant fluid, and said process characterized in that, in step (e), the light liquid phase is divided into at least two parts ($F_1$ and $F_2$), the first part ($F_1$) of the light liquid phase is vaporized in heat exchange contact with the solution from step (a), to further decrease the temperature of said solution and make its separation easier, and another part ($F_2$) of said light liquid phase is vaporized in heat exchange contact with an external medium to be cooled, other than the solution recovered from step (a).

In a first embodiment, said vaporization of the portion ($F_1$) of the light liquid phase is effected simultaneously to the heat exchange of step (d).

In a second embodiment, the vaporization of the portion ($F_1$) of the light liquid phase is effected in contact with the solution recovered from step (a), after that said solution has been cooled in step (b).

DETAILED DISCUSSION OF THE INVENTION

Figure 1:
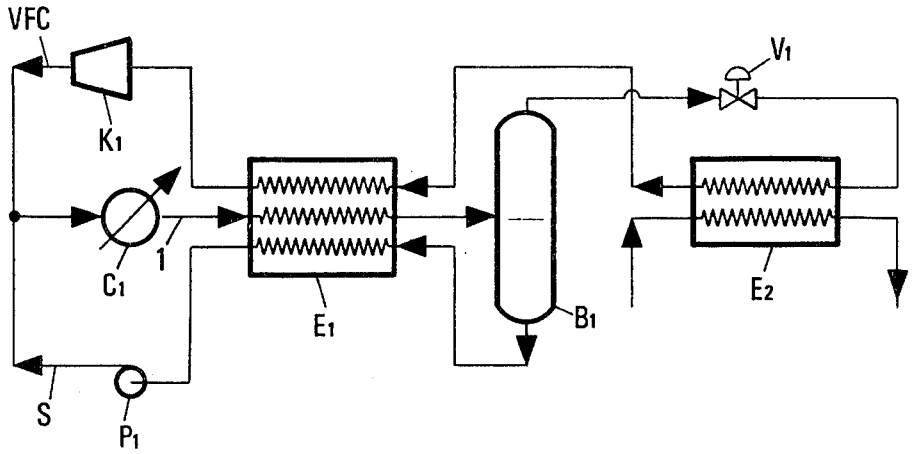
FIG. 1 is, as previously discussed, a schematic diagram illustrating an arrangement for carrying out a prior art process.
Figure 2:
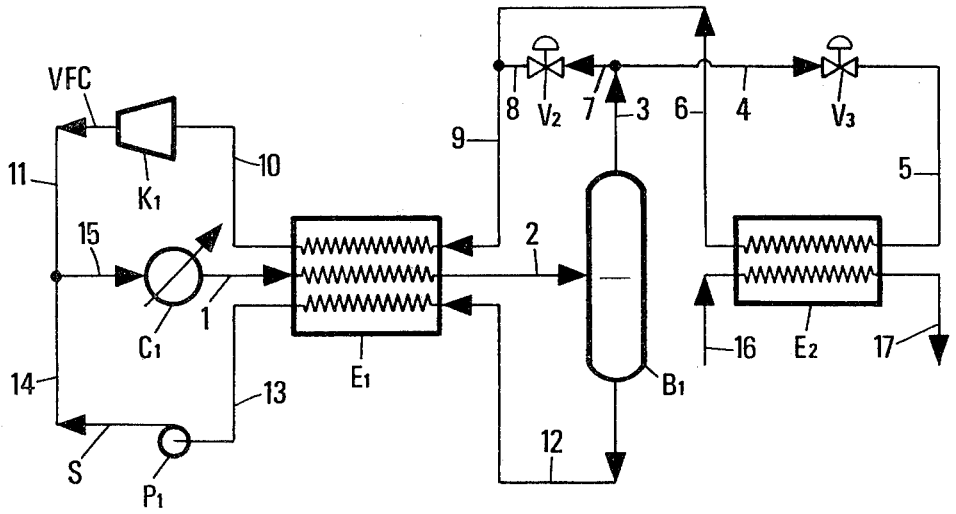
FIG. 2 is a schematic diagram of an arrangement for conducting one embodiment of the process of the invention.

The improved process of the invention, such as shown in FIG. 2, consists of separating the refrigeration fluid withdrawn from the drum B1 into two fractions. A first fraction $F_1$ is passed through the expansion valve V2 and is then contacted, in heat exchange relation, with the mixture of solvent and refrigeration fluid, to decrease its temperature to the required level. In fact, to decrease this temperature $T_d$, it is necessary to increase the fraction $F_1$ of refrigeration fluid passing through the expansion valve. The remaining fraction $F_2$ is expanded through the expansion valve V3 and vaporized through exchanger E2 to cool the external fluid supplied to the exchanger E2.

This arrangement is particularly advantageous when the temperature $T_d$ is close to the average temperature $T_f$ at which the refrigeration fluid is vaporized in exchanger E2. Conversely, if this temperature is between the temperature $T_c$ of the mixture withdrawn from the condenser and the temperature $T_f$, the arrangement of FIG. 2 leads to an expansion of the fraction $F_1$ to an unnecessarily low pressure. It is then possible to operate according to the diagram of FIG. 3.

In this diagram, the fraction $F_1$ is expanded at a pressure intermediate between the low pressure and the high pressure of the cycle. In that case, to reduce the consumption of compression power, it is advantageous, if the compression of the refrigeration fluid is effected in several stages, to introduce the vapor phase obtained by vaporization of the fraction $F_1$ at an intermediate point of the compressor.

Figure 3:
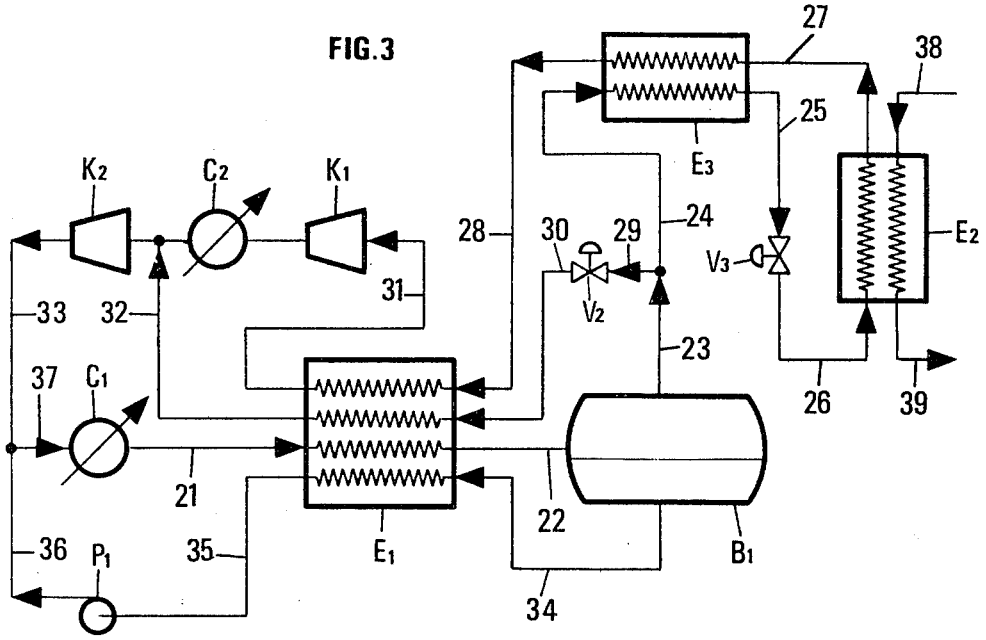
FIG. 3 is a schematic diagram of another arrangement for another mode of operation according to the invention.

A number of arrangements are possible to effect the additional cooling of the mixture of solvent and refrigeration fluid obtained by vaporization of the fraction $F_1$. This cooling can be effected in the same exchanger as used to effect the exchange with the recycled solvent phase (FIGS. 2 and 3). This necessitates a multi-passage exchanger. These exchangers are available in the cold generating industry. They can consist, for example, of plate exchangers such as brazed aluminum plate exchangers or coil exchangers.

Figure 4:
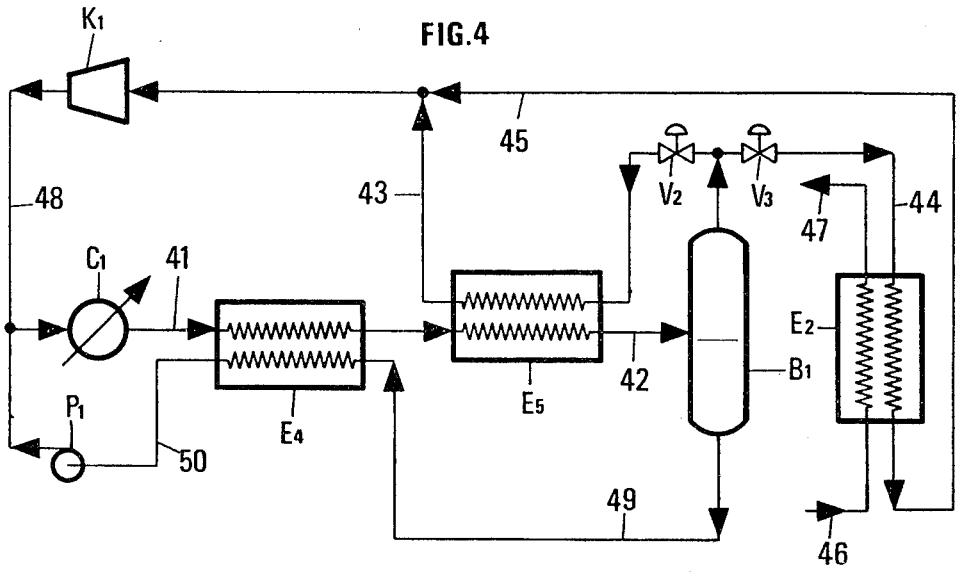
FIG. 4 is still another schematic diagram of an arrangement for carrying out a third mode of operation according to the invention.

The cooling of the mixture of solvent and refrigerant fluid withdrawn from exchanger C1 can also be effected in two successive steps as indicated, for example, in the diagram of FIG. 4.

In this diagram, the mixture of solvent and refrigerant fluid withdrawn from the exchanger C1 is cooled successively in exchanger E4 by heat exchange with the recycled solvent phase, and then in exchanger E5 by heat exchange with the fraction $F_1$ which vaporizes. In this diagram, the vapor phase obtained by mixing the vapor fractions formed by vaporization of the liquid fractions $F_1$ and $F_2$ is fed back directly to compressor K1. In this manner, the exchangers E4 and E5 can consist of conventional tube-and-calender exchangers.

Another method consists of exchanging heat between the fraction $F_2$ withdrawn from exchanger E2 and the solution withdrawn from condenser C1. This can be effected, for example, in the exchanger E4 which will then be a 3-way exchanger.

The invention operates with all the mixtures of refrigeration fluid and solvent adapted to perform the dissolution step with transmission of dissolution heat to an external fluid, and the liquid-liquid phase separation step by decrease of the temperature.

The dissolution step can advantageously be performed at a temperature close to room temperature, this temperature being obtained by heat exchange with water or air. This temperature can be chosen to be, for example, between 20° and 50° C. However, to obtain very low refrigeration temperatures with the use of a refrigeration fluid with a very low boiling point, it is possible to operate this dissolution at a lower temperature with the use of an auxiliary refrigeration installation.

The refrigeration fluid can be selected from the following fluids, although this list does not constitute a limitation of the scope of the invention:

1. Hydrocarbons with, preferably, 1 to 3 carbon atoms per molecule, for example, methane, ethane and propane.
2. Halogenated hydrocarbons or "fluorocarbon" fluids of the "Freon" type with, preferably, 1 or 2 carbon atoms per molecule.
   Examples of such fluids are:
   R-22: chlorodifluoromethane
   R-23: trifluoromethane
   R-13: chlorotrifluoromethane
   R-115: chloropentafluoroethane
   R-13B1: trifluorobromomethane
   R-14: tetrafluoromethane
3. Other gases conventionally used in refrigeration processes:
   carbon dioxide
   ammonia At the lowest temperature levels, other fluids such as nitrogen, helium and hydrogen, which are used to attain such temperatures, can also be used.

The solvent is preferably a polar solvent, for example, an alcohol, a ketone, an aldehyde, an ether, a nitro derivative, a nitrile, an amide or an amine. The chemical formulas of these solvents are, for example, R—OH, R—CO—R', R—CHO, R—O—R', R—$NO_2$, R—CN, R—$CONH_2$, R—$NH_2$, R—NH—R' or NRR'R", wherein R, R' and R" are alkyl radicals with 1 to 3 carbon atoms.

The solvent can thus be, for example, methanol, ethanol, propanol, butanol, acetone, acetaldehyde, propionitrile, nitropropane, ethyl ether, tetrahydrofuran, dimethylformamide, ammonia, methylamine or trimethylamine. The solvent can also be a perfluorinated compound such as FC75 of the chemical formula $C_8F_{16}O$ or FC77 of the chemical formula $C_8F_{18}$.

The refrigeration fluid-solvent pairs can be, for example, (the first name is that of the refrigeration fluid):
ethane+acetone
ethane+propionitrile
propane+propionitrile
ethylene+FC75
ethylene+FC77
R-13+propanol
R-23+propanol
R-115+propanol
R-115+ethanol Other types of solvents can be used in certain cases; for example, a hydrocarbon or a halogenated hydrocarbon can be used as solvent.

The following pair can thus be used: R-13+toluene.

Very low temperatures can be obtained with, for example, the following pair: nitrogen+ethane.

The solvents can be used either pure, or as mixtures. Thus, using a mixture of two solvents whose dissolution capacities are different, it is possible, by modifying the relative proportion of these solvents to adjust the refrigeration fluid concentration.

For example, with the use of ethane as refrigeration fluid, it is possible to employ an acetone-methanol mixture. By increasing the methanol proportion, the ethane concentration decreases at the temperature $T_d$.

The solvent can also be a lubricant, particularly the lubricant used in the compressor, provided the compressor is a lubricated compressor. The lubricant can be a hydrocarbon base. In that case, the refrigeration fluid preferably consists of a halogenated hydrocarbon or a "fluorocarbon" fluid of the "Freon" type, such as R-22, R-23, R-13, R-115, R-13B1 or R-14. This hydrocarbon base may be of the naphthenic or paraffinic type. It has been observed that, by decrease of the temperature, the liquid-liquid settling is more acute and the separation of the two liquid phases more complete in the case of a paraffinic base than in the case of a naphthenic base. It can thus be understood that, by mixing the two types of lubricants, it is possible to adjust the mutual solubility so as to obtain a sufficient dissolution of the refrigeration fluid at the temperature of the condenser C1 and a sufficiently acute phase separation at the temperature $T_d$. It is also possible to use a synthesis lubricant as the solvent. Various types of polymers can be used. The lubricant can be, for example, of the polyolefin or alkylphenyl type.

The lower pressure of the cycle is generally between 1 and 10 atm, and the higher pressure of the cycle is generally between 10 and 70 atm.

Various arrangements of equipment can be used to perform the steps of the process.

The compressor can be, for example, a piston compressor, a screw compressor, a centrifuge compressor or an axial compressor with one or more stages; intermediary coolings can be conducted between the stages.

The exchangers can be, for example, tube-and-calender exchangers, coil exchangers or plate exchangers. Surface coatings can be used to facilitate the vaporization or condensation of the products.

When the solvent phase and the refrigeration fluid are contacted, the dissolution heat being evacuated through the exchanger C1, this contact may be made easier by using devices which improve the mixing of the liquid phase with the vapor phase, e.g. a helixes, packings, etc.

The expansion devices can be automatically controlled. Thus, the expansion valve V3 can be adjusted so as to maintain an imposed refrigeration temperature in the exchanger E2, and the expansion valve V2 can be so adjusted so as to maintain an imposed temperature $T_d$ at the outlet of the exchanger E1.

EXAMPLE 1

In this example, the operation conforms to the diagram of FIG. 2. In duct 1, at the outlet of exchanger C1, the liquid mixture consists of ethane and acetone; the composition as molar fraction is: ethane: 0.6—acetone: 0.4. The temperature is 35° C. and the pressure 4.25 MPa. The feed rate is 10,750 kg/h. The mixture is passed through the exchanger E1 wherefrom it is withdrawn through duct 2 at a temperature of −70° C. The temperature decrease leads to settling of the mixture into two liquid phases which are separated in the drum B1.

The light phase consists of 96% by mole of ethane and 4% by mole of acetone; and it is discharged from drum B1 through duct 3 at a rate of 3250 kg/h. A portion of this light phase (duct 4), amounting to 2340 kg/h, is expanded through valve V3 to a pressure of 0.2 MPa, which decreases its temperature to −75° C.; and it is then introduced into exchanger E2 through duct 5. In exchanger E2, ethane is vaporized at a temperature of −75° C., thus delivering cold to an external fluid which is fed to exchanger E2 through duct 16 and discharged through duct 17. The amount of cold produced is 273.2 kW. The other part of the light phase, amounting to 910 kg/h, is fed through duct 7 to valve V2 to be expanded to a pressure of 0.2 MPa, which decreases its temperature to −75° C.; it is withdrawn through duct 8 to be admixed with gaseous ethane supplied from exchanger E2 through duct 6. The resultant gas-liquid mixture is fed from duct 9 into exchanger E1 where liquid ethane and acetone vaporize. At the outlet of exchanger E1, in duct 10, the mixture is fully gaseous and its temperature is 30° C.; it is passed through compressor K1 where it is compressed in 2 stages with intermediary cooling, to a pressure of 4.3 MPa. The high pressure gas is fed through duct 11 to the exchanger C1.

The heavy fraction of drum B1 consists of 36% ethane and 65% acetone, by mole; it is discharged through duct 12 and passed through exchanger E1 wherefrom it is withdrawn through duct 13 at a temperature of 30° C.; it is fed to pump P1 and supplied to duct 14 to be admixed in line 15 with high pressure ethane discharged from compressor K1. In exchanger C1, gaseous ethane dissolves into acetone with heat release, which heat is delivered to an external fluid.

EXAMPLE 2

In this example, the operation is conducted as shown in FIG. 3. In duct 21, at the outlet from exchanger C1, the liquid mixture consists of ethane and an equimolecular mixture of acetone and methanol; the composition by molar fraction is: ethane, 0.5; equimolecular acetone-methanol mixture, 0.5. The temperature is 30° C. and the pressure 4.15 MPa. The feed rate is 14630 kg/h. The mixture is passed through exchanger E1 wherefrom it is discharged through duct 22 at a temperature of −40° C. The temperature decrease results in a separation of the mixture into two liquid phases which are separated in drum B1.

The light phase contains 90% b.w. of ethane; it is withdrawn from drum B1 through duct 23 at a rate of 3350 kg/h. A portion of this light phase, amounting to 1976 kg/h, is introduced through duct 24 into the subcooling exchanger E3. It is withdrawn through duct 25 at a temperature of −62° C., expanded in valve V3 to a pressure of 0.12 MPa and feeds exchanger E2 through duct 26. In this exchanger, ethane vaporizes at a temperature of −85° C., thus delivering cold to an external fluid fed to exchanger E2 through duct 38 and discharged through duct 39: the amount of cold produced is 207.2 kW. The light phase is discharged from exchanger E2 through duct 27 at a temperature of −85° C.; it is fed to exchanger E3 wherefrom it is discharged at a temperature of −45° C. through duct 28; through this same duct, it feeds exchanger E1 and is discharged at a temperature of 25° C., in fully gaseous condition. This gas is sucked or drawn in the first stage of compressor K1 through duct 31. At the outlet of the first compression stage, the gas is at a pressure of 0.707 MPa; it passes through an intermediary cooler C2 to bring its temperature back to 30° C. The second portion of the light phase (i.e., through duct 29), amounting to 1374 kg/h, supplied from duct 23, is expanded through valve V2 to a pressure of 0.707 MPa, which decreases its temperature to −43° C.: it feeds exchanger E1 through duct 30 and is discharged in fully gaseous condition at a temperature of 25° C. through duct 32; it is then admixed with the portion discharged from the first compression stage. The whole light gas phase is sucked or drawn in the second stage of the compressor, wherefrom it is withdrawn at a pressure of 4.25 MPa. The high pressure gas is fed through duct 33 to the exchanger C1.

The heavy fraction of drum B1 contains 25.3% b.w. of ethane. It is discharged through duct 34 and passed through exchanger E1; it is withdrawn therefrom through duct 35 at a temperature of 25° C.; it is taken up in pump P1 and fed back through duct 36 to admixed in line 37 with high pressure ethane from the compressor. In exchanger C1, gaseous ethane dissolves in the solvent with heat release, which heat is delivered to an external fluid.

EXAMPLE 3

The diagram is shown in FIG. 4 and the liquid mixture is the same as in example 1. This gaseous mixture (i.e., through duct 41) at a temperature of 32° C., is fed to exchanger E4 and then to exchanger E5. It passes in the liquid state in duct 42 and settles in drum B1 at a temperature of −70° C. A portion of the light phase is expanded in valve V2 and supplied to duct 43 at a pressure of 0.2 MPa; another portion is expanded in valve V3 and fed at −75° C. and 0.2 MPa to exchanger E2 through duct 44. It delivers cold to a fluid circulated in ducts 46 and 47. It is withdrawn through duct 45 and passed to compressor K1 after mixing with the light phase of duct 43. The resultant gaseous mixture is compressed to 4.2 MPa and fed to exchanger C1 through duct 48. The heavy liquid phase of drum B1 passes through duct 49, exchanger E4 and duct 50 where its pressure is raised through pump P1 to 4.2 MPa. It is thereafter admixed with the light phase of duct 48.

Although in example 2 there had been used an equimolar mixture of acetone and methanol, it has been found that mixtures of 20 to 80% by mole of acetone with 80 to 20% by mole of methanol can successfully be used.

What is claimed is:

1. In a process for producing cold in a phase separation cycle, which comprises the steps of:

(a) compressing, in a compression zone, a gas phase of a refrigerant fluid, to form a compressed gas phase, dissolving at least in part the compressed gas phase in a liquid solvent phase, to obtain a solution, and transferring at least in part the compression heat and the dissolution heat to an external cooling fluid, (b) cooling the solution recovered from step (a) in the manner defined in step (d) hereinafter, to obtain the separation of the solution into two distinct liquid phases, (c) separating the light liquid phase from the heavy liquid phase, (d) contacting the heavy liquid phase of step (c), in heat exchange relationship, with the solution to be cooled of step (b), and thereafter supplying said heavy liquid phase, as a solvent phase, to step (a) to dissolve an additional amount of compressed gas phase, (e) expanding the light liquid phase of step (c) and vaporizing it to produce cold, (f) recycling the vaporized light phase of step (e) to the compression zone of step (a) as a gas phase of refrigerant fluid, with the improvement comprising: dividing the light liquid phase in step (e) into at least two portions ($F_1$) and ($F_2$); vaporizing the one portion ($F_1$) of the light liquid phase in heat exchange contact with the solution from step (a), to further decrease the temperature of said solution and to facilitate its separation in step (b); and vaporizing the other portion ($F_2$) of said light liquid phase in heat exchange contact with an external medium which is cooled, and said external medium being a medium other than the solution recovered from step (a).

2. In a process for cooling an external medium, which comprises the steps of:

(a) compressing, in a compression zone, a gas phase of a refrigerant fluid, to form a compressed gas phase, dissolving at least in part the compressed gas phase in a liquid solvent phase, to obtain a solution, and transferring at least in part the compression heat and the dissolution heat to an external cooling fluid, (b) contacting the solution obtained in step (a), in heat exchange relationship, with a heavy liquid phase obtained in step (c) as defined hereinafter, with the contacting conducted in the manner defined in step (d) hereinafter, to cool said solution and obtain separation of the solution into two distinct liquid phases, with said two distinct liquid phases being a light liquid phase and a heavy liquid phase, (c) separating the light liquid phase from the heavy liquid phase, (d) contacting the heavy liquid phase separated in step (c), in heat exchange relationship, with the solution to be cooled in step (b), and thereafter supplying said heavy liquid phase, as a solvent phase, to step (a) to dissolve an additional amount of compressed gas phase, (e) expanding the light liquid phase separated in step (c) and vaporizing at least a fraction of the resultant expanded light liquid phase in heat exchange contact with an external medium to be cooled, and (f) recycling the vaporized light phase of step (e) to the compression zone of step (a) as gas phase of refrigerant fluid, the improvement comprising: dividing the light liquid phase of step (e) into at least two portions ($F_1$) and ($F_2$); vaporizing the one portion ($F_2$) of said light liquid phase as said vaporized fraction of the resultant light liquid phase of step (e) in said heat exchange contact with the external medium to be cooled; and vaporizing the other portion ($F_1$) of said light liquid phase in heat exchange contact with the solution to be cooled of step (b), to further decrease the temperature of said solution and make its separation easier.

3. A process according to claim 1, wherein said vaporization of the portion ($F_1$) of the light liquid phase is effected simultaneously to the heat exchange of step (d).

4. A process according to claim 1, wherein said vaporization of the portion ($F_1$) of the light liquid phase is effected in contact with the solution recovered from step (a), after that solution has been cooled in step (b).

5. A process according to claim 1, wherein, in step (e), the portion ($F_1$) of the light liquid phase to be vaporized in contact with the solution recovered from step (a) is subjected to a smaller expansion than the portion ($F_2$) of the light liquid phase to be vaporized in contact with the external medium to be cooled, and wherein the portion ($F_2$), after vaporization, is fed to the inlet of the compression zone and the portion ($F_1$) to an intermediate point of said compression zone.

6. A process according to claim 1, wherein the portion ($F_2$) of the light liquid phase, after expansion and vaporization in contact with the external medium to be cooled, is contacted in heat exchange relation, with an additional amount of the same portion ($F_2$) before expansion of the latter.

7. A process according to claim 1, wherein the portion ($F_2$) of the light liquid phase, after expansion and vaporization in contact with the external medium to be cooled, is contacted, in heat exchange relation, with the solution to be cooled, recovered from step (a) before its fractionation in step (c).

8. A process according to claim 2, wherein the refrigerant fluid consists of one or more hydrocarbons, one or more halogenated hydrocarbons, carbon dioxide, carbon monoxide, ammonia, nitrogen, helium, hydrogen or a mixture of several of these fluids, and the solvent is a compound selected from the alcohols, ketones, aldehydes, ethers, esters, nitro derivatives, nitriles, amides, amines, hydrocarbons, fluorinated or chlorinated hydrocarbons, or a mixture of several of these compounds.

9. A process according to claim 2, wherein the refrigerant fluid consists of one or more halogenated hydrocarbons and the solvent is propanol.

10. A process according to claim 2, wherein the refrigerant fluid is ethane and the solvent is a mixture of 20 to 80% by mole of acetone with 80 to 20% by mole of methanol.

11. A process according to claim 2, wherein the refrigerant fluid is ethane and the solvent is acetone.

12. A process according to claim 1 to 10, wherein the heat exchange between the portion ($F_1$) of the vaporized light liquid phase and the solution recovered from step (a) is effected in counter-current.

13. A process according to claim 2, operated in a refrigeration machine comprising a lubricated compressor and wherein the refrigerant fluid is selected from the halogenated hydrocarbons and the solvent consists of the same liquid as used to lubricate the compressor.

14. A process according to claim 1 further comprising controlling the amount of cooling of the solution in step (b) by adjusting the amount in the fraction of the portion ($F_1$) which is vaporized in contact with the solution being cooled in step (b).

15. A process according to claim 13 further comprising controlling the amount of cooling of the solution in step (b) by adjusting the amount in the fraction of the portion ($F_1$) which is vaporized in contact with the solution being cooled in step (b).

16. A process according to claim 2, wherein said vaporization of the portion ($F_1$) of the light liquid phase is effected simultaneously to the heat exchange of step (d).

17. A process accorrding to claim 2, wherein said vaporization of the portion ($F_1$) of the light liquid phase is effected in contact with the solution recovered from step (a), after that solution has been cooled in step (b).

18. A process according to claim 2, wherein, in step (e), the portion ($F_1$) of the light liquid phase to be vaporized in contact with the solution recovered from step (a) is subjected to a smaller expansion than the portion ($F_2$) of the light liquid phase to be vaporized in contact with the external medium to be cooled, and wherein the portion ($F_2$), after vaporization, is fed to the inlet of the compression zone and the portion ($F_1$) to an intermediate point of said compression zone.

19. A process according to claim 2, wherein the portion ($F_2$) of the light liquid phase, after expansion and vaporization in contact with the external medium to be cooled, is contacted in heat exchange relation, with an additional amount of the same portion ($F_2$) before expansion of the latter.

20. A process according to claim 2, wherein the portion ($F_2$) of the light liquid phase, after expansion and vaporization in contact with the external medium to be cooled, is contacted, in heat exchange relation, with the solution to be cooled, recovered from step (a) before its fractionation in step (c).

* * * * *